US011688352B2

(12) United States Patent
Choi et al.

(10) Patent No.: US 11,688,352 B2
(45) Date of Patent: Jun. 27, 2023

(54) TECHNIQUE FOR REDUCING DISPLAY CROSSTALK AND SYSTEMS IMPLEMENTING THE SAME

(71) Applicant: Google LLC, Mountain View, CA (US)

(72) Inventors: Sangmoo Choi, Palo Alto, CA (US); Wonjae Choi, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/967,192

(22) PCT Filed: Sep. 9, 2019

(86) PCT No.: PCT/US2019/050225

§ 371 (c)(1),
(2) Date: Aug. 4, 2020

(87) PCT Pub. No.: WO2021/050040

PCT Pub. Date: Mar. 18, 2021

(65) Prior Publication Data

US 2022/0415263 A1 Dec. 29, 2022

(51) Int. Cl.

*G09G 3/3291* (2016.01)
*G09G 3/3233* (2016.01)
*G09G 3/3266* (2016.01)

(52) U.S. Cl.

CPC ..... *G09G 3/3291* (2013.01); *G09G 3/3233* (2013.01); *G09G 3/3266* (2013.01); (Continued)

(58) Field of Classification Search

CPC .. G09G 3/3291; G09G 3/3233; G09G 3/3266; G09G 2310/027; G09G 2320/0209; G09G 2360/16

See application file for complete search history.

(56) References Cited

U.S. PATENT DOCUMENTS

2006/0238472 A1* 10/2006 Lee ..... G09G 3/3688 345/89
2012/0249620 A1 10/2012 Choi et al.
(Continued)

OTHER PUBLICATIONS

PCT International Preliminary Report on Patentability in International Appln. No. PCT/US2019/050225, dated Mar. 17, 2022, 9 pages.

(Continued)

*Primary Examiner* — Kenneth B Lee, Jr.
(74) *Attorney, Agent, or Firm* — Fish & Richardson P.C.

(57) ABSTRACT

Methods, systems, and apparatus, including computer programs encoded on computer storage media, for displaying an image on a flat panel display with an array of pixels. A method includes receiving image data including a grayscale value for each pixel; determining a grayscale delta for each pixel where the grayscale delta is a variation between the grayscale value for a given pixel addressable by a first scan line and the grayscale value for another pixel addressable by a scan line addressed prior to the first scan line; determining an aggregated grayscale delta for the first scan line; comparing a magnitude of the aggregated grayscale delta to a threshold value corresponding to a data signal that results in line crosstalk; modifying the image data when the magnitude of the aggregated grayscale delta equals or exceeds the threshold value, and displaying the image on the flat panel display using the modified image data.

20 Claims, 7 Drawing Sheets

(52) U.S. Cl.
CPC ..... *G09G 2310/027* (2013.01); *G09G 2320/0209* (2013.01); *G09G 2360/16* (2013.01)

(56) References Cited

U.S. PATENT DOCUMENTS

2016/0133176 A1* 5/2016 Oh ..... G09G 3/3648 345/694
2019/0005897 A1* 1/2019 Luthra ..... G09G 3/3426

OTHER PUBLICATIONS

PCT International Search Report and Written Opinion in International Appln No. PCT/US2019/050225, dated May 29, 2020, 14 pages.

* cited by examiner

402

Pixel Grayscale Values $0 \leq G_{SD} \leq 255$

| Scan Line (S) | Data Line (D) 1 | 2 | 3 | 4 | 5 | 6 | 7 | 8 | 9 | 10 |
|---|---|---|---|---|---|---|---|---|---|---|
| 1 | 254 | 254 | 254 | 254 | 254 | 254 | 254 | 254 | 254 | 254 |
| 2 | 240 | 240 | 240 | 240 | 240 | 240 | 240 | 240 | 240 | 240 |
| 3 | 230 | 230 | 254 | 230 | 254 | 230 | 230 | 254 | 230 | 254 |
| 4 | 254 | 0 | 0 | 0 | 0 | 0 | 0 | 0 | 254 | 0 |
| 5 | 254 | 0 | 0 | 0 | 0 | 0 | 0 | 0 | 254 | 254 |
| 6 | 254 | 0 | 0 | 0 | 0 | 0 | 0 | 0 | 254 | 254 |
| 7 | 254 | 0 | 0 | 0 | 0 | 0 | 0 | 0 | 254 | 254 |
| 8 | 254 | 254 | 254 | 254 | 254 | 254 | 254 | 254 | 254 | 254 |
| 9 | 254 | 254 | 254 | 254 | 254 | 254 | 254 | 254 | 254 | 254 |
| 10 | 254 | 0 | 254 | 254 | 254 | 254 | 254 | 254 | 254 | 254 |

404

Pixel Grayscale Deltas $\Delta_{SD} = G_{SD} - G_{(S-1)D}$

| Scan Line (S) | Data Line (D) 1 | 2 | 3 | 4 | 5 | 6 | 7 | 8 | 9 | 10 |
|---|---|---|---|---|---|---|---|---|---|---|
| 1 | N/A | N/A | N/A | N/A | N/A | N/A | N/A | N/A | N/A | N/A |
| 2 | -14 | -14 | -14 | -14 | -14 | -14 | -14 | -14 | -14 | -14 |
| 3 | -10 | -10 | 14 | -10 | 14 | -10 | -10 | 14 | -10 | 14 |
| 4 | 24 | -230 | -254 | -230 | -254 | -230 | -230 | -254 | 24 | -254 |
| 5 | 0 | 0 | 0 | 0 | 0 | 0 | 0 | 0 | 0 | 254 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 8 | 0 | 254 | 254 | 254 | 254 | 254 | 254 | 254 | 0 | 0 |
| 9 | 0 | 0 | 0 | 0 | 0 | 0 | 0 | 0 | 0 | 0 |
| 10 | 0 | -254 | 0 | 0 | 0 | 0 | 0 | 0 | 0 | 0 |

Aggregated Grayscale Deltas $$|\Sigma_S| = \left| \sum_{D=1}^{10} \Delta_{SD} \right|$$

406

| Sum | Magnitude |
|---|---|
| N/A | N/A |
| -140 | 140 |
| -4 | 4 |
| -1888 | **1888** |
| 254 | 254 |
| 0 | 0 |
| 0 | 0 |
| 1778 | **1778** |
| 0 | 0 |
| -254 | 254 |

Threshold Aggregated Grayscale Delta $|\Sigma_S| < T$

T=1500

FIG. 4

502

Modified Pixel Grayscale Values $0 \leq G_{SD}^* \leq 255$

| Scan Line (S) | Data Line (D) 1 | 2 | 3 | 4 | 5 | 6 | 7 | 8 | 9 | 10 |
|---|---|---|---|---|---|---|---|---|---|---|
| 1 | 254 | 254 | 254 | 254 | 254 | 254 | 254 | 254 | 254 | 254 |
| 2 | 240 | 240 | 240 | 240 | 240 | 240 | 240 | 240 | 240 | 240 |
| 3 | 230 | 230 | 254 | 230 | 254 | 230 | 230 | 254 | 230 | 254 |
| 4 | 255 | **115** | **127** | **115** | **127** | **115** | **115** | **127** | 255 | 0 |
| 5 | 254 | 0 | 0 | 0 | 0 | 0 | 0 | 0 | 254 | 254 |
| 6 | 254 | 0 | 0 | 0 | 0 | 0 | 0 | 0 | 254 | 254 |
| 7 | 254 | 0 | 0 | 0 | 0 | 0 | 0 | 0 | 254 | 254 |
| 8 | 255 | **127** | **127** | **127** | **127** | **127** | **127** | **127** | 255 | 255 |
| 9 | 254 | 254 | 254 | 254 | 254 | 254 | 254 | 254 | 254 | 254 |
| 10 | 254 | 0 | 254 | 254 | 254 | 254 | 254 | 254 | 254 | 254 |

504

Modified Pixel Grayscale Deltas $\Delta_{SD}^* = G_{SD}^* - G_{(S-1)D}^*$

| Scan Line (S) | Data Line (D) 1 | 2 | 3 | 4 | 5 | 6 | 7 | 8 | 9 | 10 |
|---|---|---|---|---|---|---|---|---|---|---|
| 1 | N/A | N/A | N/A | N/A | N/A | N/A | N/A | N/A | N/A | N/A |
| 2 | -14 | -14 | -14 | -14 | -14 | -14 | -14 | -14 | -14 | -14 |
| 3 | -10 | -10 | 14 | -10 | 14 | -10 | -10 | 14 | -10 | 14 |
| 4 | 25 | -115 | -127 | -115 | -127 | -115 | -115 | -127 | 25 | -254 |
| 5 | -1 | -115 | -127 | -115 | -127 | -115 | -115 | -127 | -1 | 254 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 8 | 1 | 127 | 127 | 127 | 127 | 127 | 127 | 127 | 1 | 1 |
| 9 | -1 | 127 | 127 | 127 | 127 | 127 | 127 | 127 | -1 | -1 |
| 10 | 0 | -254 | 0 | 0 | 0 | 0 | 0 | 0 | 0 | 0 |

Modified Aggregated Grayscale Deltas $$|\Sigma_S^*| = \left|\sum_{D=1}^{10} \Delta_{SD}^*\right|$$

506

| Sum | Magnitude |
|---|---|
| N/A | N/A |
| -140 | 140 |
| -4 | 4 |
| -1045 | 1045 |
| -589 | 589 |
| 0 | 0 |
| 0 | 0 |
| 892 | 892 |
| 886 | 886 |
| -254 | 254 |

Threshold Aggregated Grayscale Delta $|\Sigma_S^*| < T$

T=1500

FIG. 5

TECHNIQUE FOR REDUCING DISPLAY CROSSTALK AND SYSTEMS IMPLEMENTING THE SAME

CROSS-REFERENCE TO RELATED APPLICATION

This application is a National Stage Application under 35 U.S.C. § 371 and claims the benefit of International Application No. PCT/US2019/050225, filed Sep. 9, 2019. The disclosure of the foregoing application is hereby incorporated by reference in its entirety.

TECHNICAL FIELD

This specification relates generally to flat panel displays and reducing crosstalk in flat panel displays.

BACKGROUND

Electronic devices may include flat panel displays on which visual images may be shown. For example, a user of a computing device may view visual images on a flat panel display while watching a video or playing a video game.

SUMMARY

In flat panel displays, when an abrupt data voltage change occurs between pixels in a vertical or column data line, the image on the display at a horizontally neighboring area can show unwanted distortion as an artifact of this abrupt voltage change. The unwanted image distortion, which is often observed as horizontal lines, is called horizontal line crosstalk, or line crosstalk. Line crosstalk typically occurs because of parasitic capacitance between horizontal scan or power supply lines and vertical data lines in the display. Line crosstalk can worsen or become more apparent when an abrupt voltage change affects a greater number of vertical data lines simultaneously. Line crosstalk can also worsen as display resolution and operating frame frequencies increase.

Line crosstalk can be reduced by softening image pattern boundaries at which the abrupt data voltage change occurs. Softening the image pattern boundaries may include adjusting voltage levels for entire boundaries throughout the image pattern, potentially including some boundaries that do not cause observable line crosstalk. Softening the image pattern boundaries may be applied even when the number of data lines with a simultaneous abrupt voltage change is too small to cause observable line crosstalk. Therefore, when entire boundaries of the image pattern are softened, the sharpness of the image may be reduced. The reduction in sharpness can be considered an artifact, or side effect, of softening the image pattern boundaries.

A process for reducing (e.g., minimizing) display line crosstalk, while avoiding image sharpness loss, includes softening only the image pattern boundaries that include a number of data lines that have a simultaneous abrupt voltage change. The process includes modifying an image using an algorithm that introduces a gradation only for the portions of the image that need to be softened in order to reduce the line crosstalk. By limiting the gradation only to the portions of the image that cause observable line crosstalk, the process maintains image sharpness and reduces the presence of artifacts for a majority of image patterns.

In general, one innovative aspect of the subject matter described in this specification can be embodied in a method for displaying an image on a flat panel display including an array of pixels electrically addressable via a plurality of scan lines and a plurality of data lines, the scan lines being addressed sequentially in a scan direction. The method may include: receiving, at a display driver module for the flat panel display, image data for displaying the image on the flat panel display, the image data including a grayscale value for each pixel; determining a grayscale delta for each pixel from the grayscale values where, for a given pixel addressable by a first scan line of the scan lines and a first data line of the data lines, the grayscale delta is a variation between the grayscale value for the given pixel and the grayscale value for another pixel addressable by the first data line and addressable by a scan line to be addressed prior to the first scan line when displaying the image; determining an aggregated grayscale delta for the first scan line by summing the grayscale deltas of each pixel addressable by the first scan line; comparing a magnitude of the aggregated grayscale delta for the first scan line to a threshold value, the threshold value corresponding to a data signal that results in line crosstalk; modifying the image data when the magnitude of the aggregated grayscale delta equals or exceeds the threshold value such that a magnitude of a modified aggregated grayscale delta for the first scan line is below the threshold value, thereby generating modified image data; and displaying the image on the flat panel display using the modified image data.

In general, one innovative aspect of the subject matter described in this specification can be embodied in a flat panel display including an array of pixels electrically addressable via a plurality of scan lines and a plurality of data lines; and a display driver module in electrical communication with the plurality of scan lines and the plurality of data lines. The display driver module may be programmed to: receive image data for displaying an image on the flat panel display, the image data including a grayscale value for each pixel; determine a grayscale delta for each pixel from the grayscale values where, for a given pixel addressable by a first scan line of the scan lines and a first data line of the data lines, the grayscale delta is a variation between the grayscale value for the given pixel and the grayscale value for another pixel addressable via the first data line and addressable via a scan line to be addressed prior to the first scan line when displaying the image; determine an aggregated grayscale delta for the first scan line by summing the grayscale deltas of each pixel addressable by the first scan line; compare a magnitude of the aggregated grayscale delta for the first scan line to a threshold value, the threshold value corresponding to a data signal that results in line crosstalk; modify the image data when the magnitude of the aggregated grayscale delta equals or exceeds the threshold value such that a magnitude of a modified aggregated grayscale delta for the first scan line is below the threshold value, thereby generating modified image data; and apply scan signals sequentially to the plurality of scan lines and data signals to the plurality of data lines to display the image on the flat panel display using the modified image data.

The foregoing and other embodiments can each optionally include one or more of the following features, alone or in combination.

In some implementations, the magnitude of the aggregated grayscale delta is determined for a plurality of scan lines, and the image data is modified for each of the plurality of scan lines for which the magnitude of the aggregated grayscale delta equals or exceeds the threshold value.

In some implementations, the another pixel is addressable by a scan line adjacent the first scan line.

In some implementations, the another pixel is addressable by a scan line separated from the first scan line by one or more other scan lines.

In some implementations, the threshold value is determined empirically for the flat panel display.

In some implementations, the image data is modified by increasing or decreasing the grayscale value of one or more pixels addressable by the first scan line to reduce the magnitude of the aggregated grayscale delta for the first scan line.

In some implementations, the image data is modified for the one or more pixels addressable by the first scan line that each have a grayscale delta with the same sign as the aggregated grayscale delta for the first scan line.

In some implementations, the image data is not modified for the one or more pixels addressable by the first scan line unless the image data is modified for at least one other adjacent pixel addressable by the first scan line.

In some implementations, the grayscale value is a value of a subpixel of a pixel that includes multiple subpixels.

In some implementations, the grayscale value is a summation of values of multiple subpixels of a pixel that includes multiple subpixels.

In some implementations, the grayscale delta is a variation between a one or more most-significant-bits of the grayscale value for the given pixel and one or more most-significant-bits of the grayscale value for the another pixel.

In some implementations, the grayscale delta is a variation between a weighted grayscale value for the given pixel and a weighted grayscale value for the another pixel.

In some implementations, determining a weighting ratio for each of the given pixel and the another pixel based on the respective grayscale values for the given pixel and the another pixel; and determining the weighted grayscale value for each of the given pixel and the another pixel by multiplying the grayscale values for the given pixel and the another pixel by the respective weighting ratios.

In some implementations, increasing or decreasing the grayscale value of the one or more pixels includes increasing or decreasing the grayscale value of each subpixel of the one or more pixels.

In some implementations, the display is an organic light emitting diode (OLED) display.

Implementations of the above techniques include methods, apparatus, systems and computer program products. One such computer program product is suitably embodied in a non-transitory machine-readable medium that stores instructions executable by one or more processors. The instructions are configured to cause the one or more processors to perform the above-described actions.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

FIG. 4 illustrates example grayscale value grids for an image pixel array of a flat panel display.

FIG. 5 illustrates example grayscale value grids for an image pixel array of a flat panel display with modified grayscale data.

Like reference numbers and designations in the various drawings indicate like elements.

DETAILED DESCRIPTION

An example flat panel display that may experience line crosstalk is an organic light-emitting diode (OLED) display. An OLED display includes an array of pixels, each pixel including an OLED. An OLED display is driven by driver circuits including a row driver and a column driver. The row driver, e.g., a scan driver, typically selects a row of pixels in the display, and the column driver, e.g., a data driver provides data voltage to pixel circuits in the selected row. The pixel circuits generate electric current that corresponds to the data voltage, and provide the current to OLEDs of the pixel, enabling the selected OLEDs to emit light according to image data. Signal lines such as horizontal scan lines and vertical data lines may be used in controlling the pixels to display images on the display.

The light intensity of a pixel may be determined by a grayscale value. In this disclosure, the example pixel light intensities are represented as grayscale values that include integers from 0 to 255, representing an example 8-bit grayscale display. The process for reducing display line crosstalk may also be applied to other grayscale value ranges. For example, grayscale values may range from 0 to 1023 for a 10-bit display, or from 0 to 65535 for a 16-bit display. Other possible grayscale value ranges may include a range from 0 to 1, with fractional values in between, and a range from 0 percent (%) to 100%.

For a full color display that spatially synthesizes color, each pixel may include multiple color channels, or subpixels. In some examples, each pixel may include each of a red, green, and blue subpixel. In some examples, each pixel may include each of a cyan, magenta, and yellow subpixel. The light intensities of each subpixel may be represented with grayscale values as described above, e.g., integers from 0 to 255 for an 8-bit display.

Figure 1:
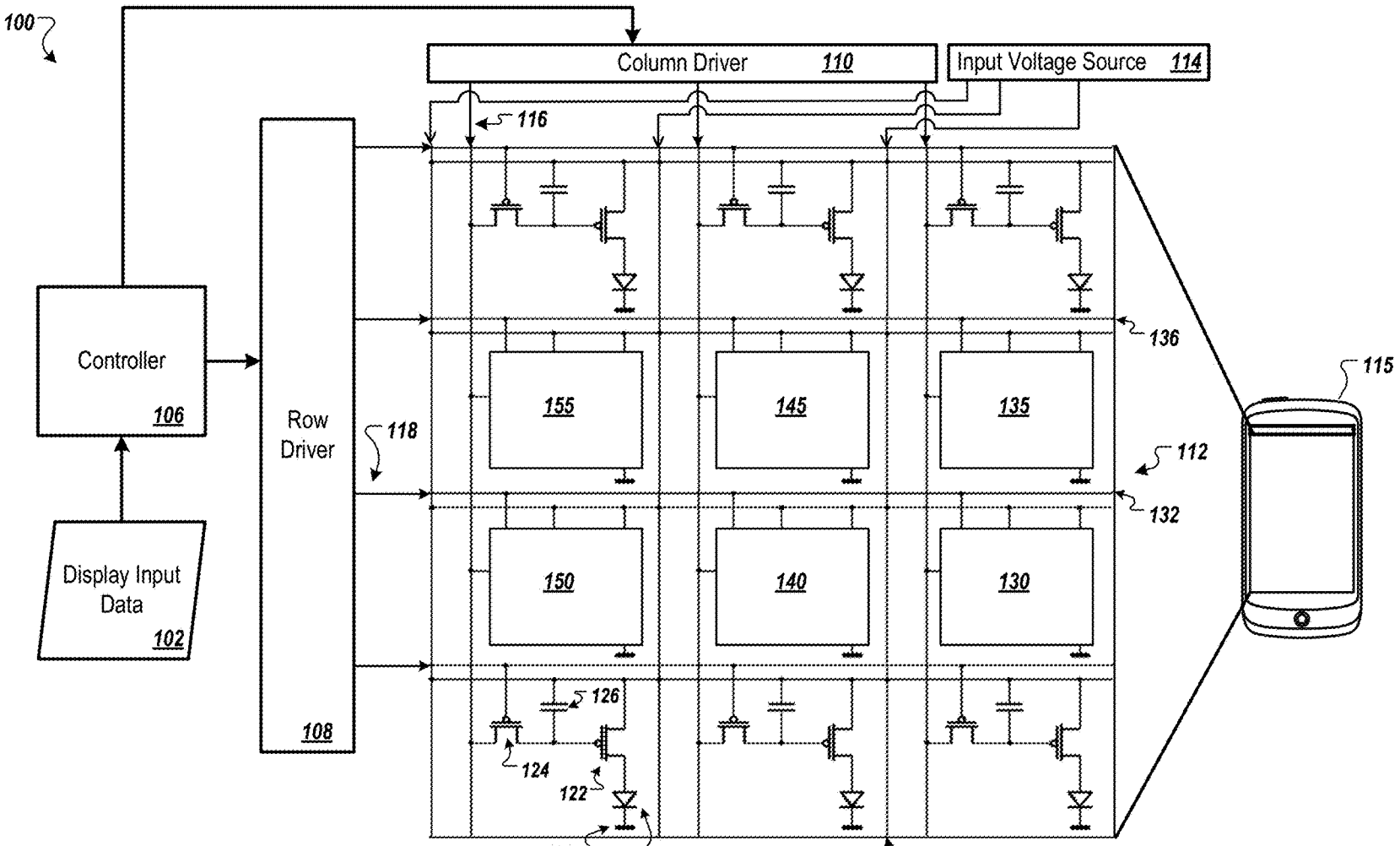
FIG. 1 is a diagram of an example display system.

FIG. 1 is a diagram of an example display system 100. The display system 100 is an OLED display system. The display system 100 is the display system for an electronic device 115. The electronic device 115 may be, for example, a smart phone, a television screen, or a handheld game console.

The display system 100 includes a pixel array 112 that includes a plurality of pixels, e.g., the pixels 130, 135, and 140, A pixel is a small unit element on a display that can reproduce a light of a color based on the image data supplied to the pixel. Each pixel within the pixel array 112 can be addressed separately to produce various light intensities of color. Only a few pixels are shown in FIG. 1 for simplicity. In practice, there may be several million pixels in the pixel array 112. Greater numbers of pixels can result in higher image resolution.

Each pixel in the pixel array 112 is addressable by a horizontal, or row, scan line and a vertical, or column, data line. For example, the pixel 150 is addressable by the scan line 118 and the data line 116. The scan lines are addressed sequentially for each image data frame. A scan direction determines the order in which the scan lines are addressed. In the display system 100, the scan direction is from top to bottom of the pixel array 112. For example, the top scan line is addressed first, followed by the second scan line from the top, followed by the third scan line from the top, etc.

The display system 100 includes a controller 106 that receives display input data 102. The controller 106 may include a graphic controller and a timing controller. The controller generates the timing of the signals for delivery to the display. The controller 106 provides the image data to the scan or row driver 108 and the data or column driver 110.

The row driver 108 and the column driver 110 provide signals to the pixels representative of the image data. The row driver 108 and the column driver 110 provide the signals to the pixels via the scan lines and the data lines. To provide the signals to the pixels, the row driver 108 selects a scan line, and the column driver 110 provides data signals, e.g., data voltage, to the pixels addressable by the selected scan line to light the selected OLEDs according to the image data.

Each pixel in the pixel array 112 includes an organic light-emitting diode (OLED) 120. An OLED includes a layer of an organic compound that emits light in response to an electric current. The organic layer is positioned between two electrodes, an anode and a cathode. Each OLED is driven by corresponding pixel circuits, in which an input voltage source 114 is a power supply.

Each pixel in the pixel array 112 includes a storage capacitor 126, a driving thin film transistor (TFT) 122, a switching TFT 124, and a connection to an OLED cathode 128.

During operation, the switching TFT 124 starts and stops the charging of the storage capacitor 126 based on receiving a signal from the scan line. During an addressing period, the scan line turns on the switching TFT 124. The switching TFT provides the data line voltage to the driving TFT 122 and the storage capacitor 126. The data line voltage is based on the image data for the pixel.

When the driving TFT 122 receives the data line voltage through the switching TFT 124, the driving TFT 122 provides a specified current to the OLED 120 based on the received data line voltage, such that the OLED 120 emits light in accordance with the electric current. The intensity or brightness of the light depends on the amount of electrical current applied. A higher current results in brighter light. Thus, the intensity of the light emitted from the OLED 120 is based on the data line voltage that corresponds to image data for the individual pixel. The storage capacitor 126 maintains the pixel state such that the pixel remains illuminated continuously after the addressing period.

Figure 2:
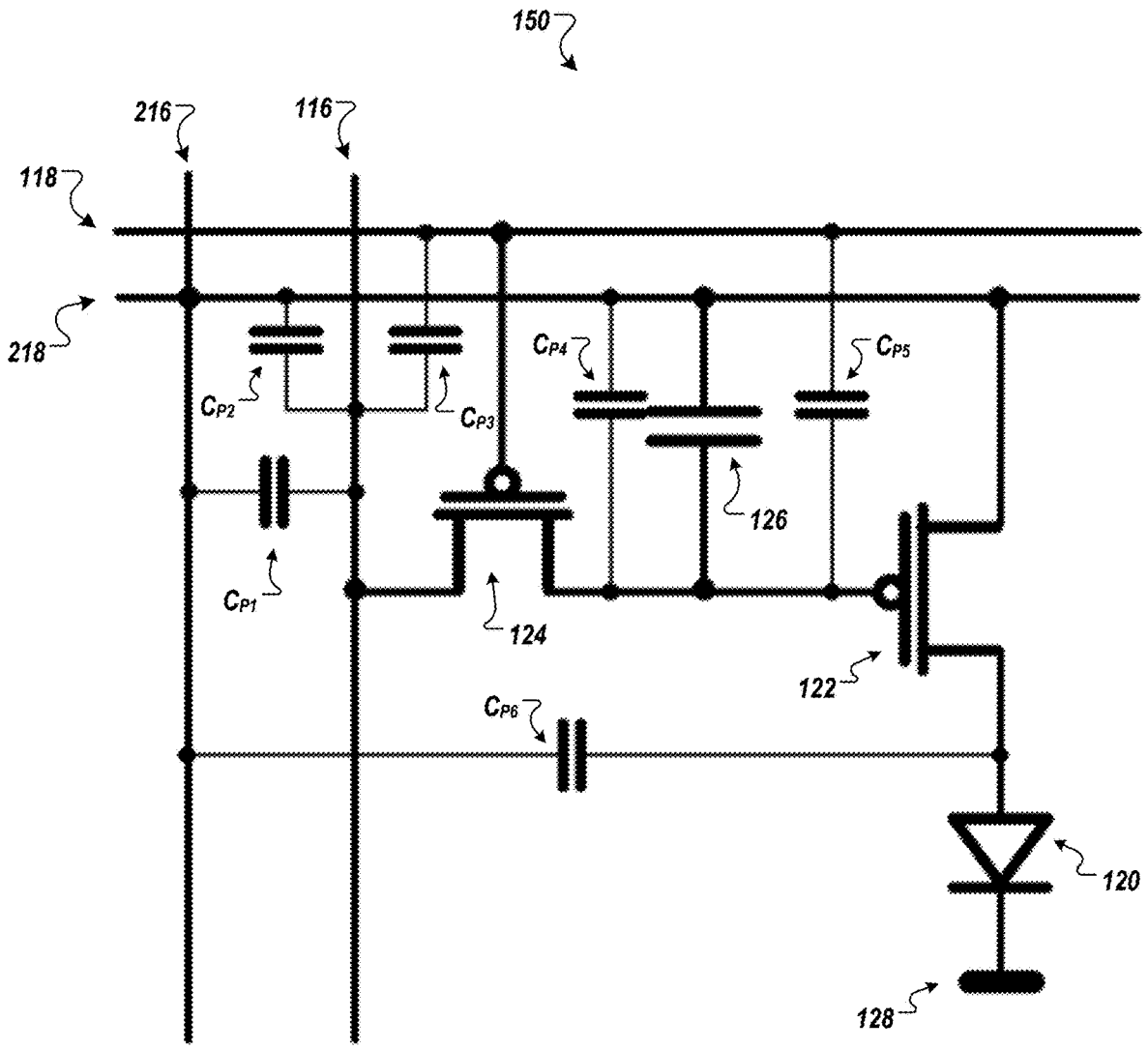
FIG. 2 is a diagram of an example pixel of a display system.

FIG. 2 is a diagram of an example pixel of a display system. For example, FIG. 2 illustrates a more detailed view of the pixel 150 of the display system 100. The pixel 150 is addressable by the horizontal scan line 118 and the vertical data line 116. The pixel receives power through vertical power supply line 216 and horizontal power supply line 218.

Parasitic capacitances may develop between capacitive components of pixels. For example, parasitic capacitance $C_{P1}$ may develop between the power supply line 216 and the data line 116. In another example, parasitic capacitance $C_{P2}$ may develop between the power supply line 218 and the data line 116. Parasitic capacitance $C_{P3}$ may also develop between the scan line 118 and the data line 116. Parasitic capacitance $C_{P4}$ may develop between the power supply line 218 and a gate electrode of the driving TFT 122, and parasitic capacitance $C_{P5}$ may develop between the scan line 118 and a gate electrode of the driving TFT 122. In another example, parasitic capacitance $C_{P6}$ may develop between the power supply line 216 and an anode of the OLED 120.

Parasitic capacitance, e.g., $C_{P1}$ to $C_{P6}$, can compromise the performance of the pixels in the display system 100. For example, parasitic capacitance can disrupt the charge stored on the storage capacitor 126. The disruption can lead to visible artifacts, or anomalies, on the display. Specifically, parasitic capacitance can cause line crosstalk. Line crosstalk results in unwanted lines shown on the display at boundaries where there are abrupt data voltage changes. A process for reducing line crosstalk is described in reference to FIG. 3.

Although FIG. 1 and FIG. 2 illustrate example components of an OLED display, the process for reducing line crosstalk may be applied to any flat panel display that includes an array of pixels. For example, the process for reducing line crosstalk may be applied to light emitting diode (LED) liquid crystal displays (LCD) and plasma display panels (PDP).

Figure 3:
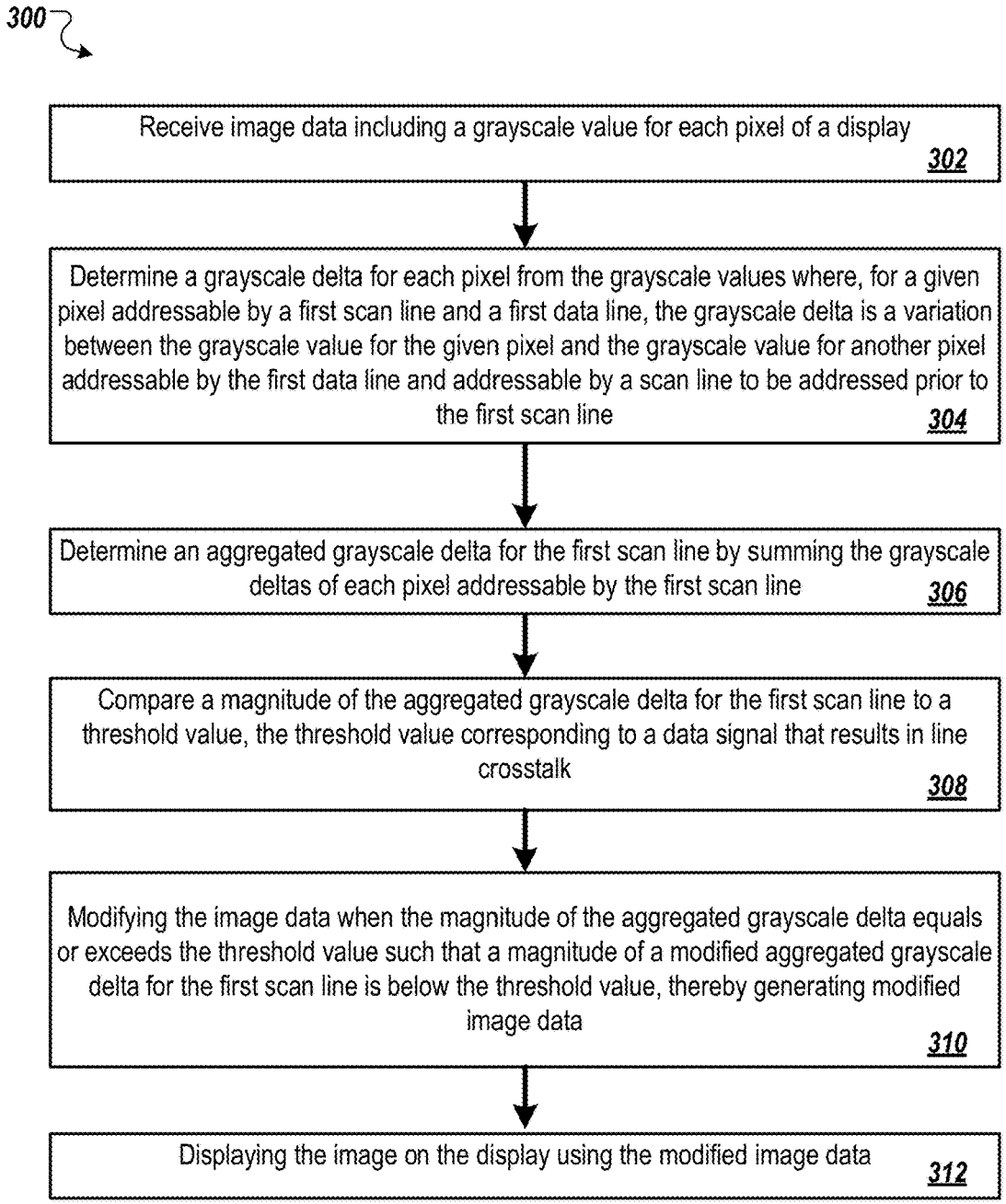
FIG. 3 is a flow diagram that illustrates an example process for reducing display line crosstalk.

FIG. 3 is a flow diagram that illustrates an example process 300 for reducing display line crosstalk. Briefly, the process 300 includes receiving image data including a grayscale value for each pixel of a display (302), determining a grayscale delta for each pixel from the grayscale values where, for a given pixel addressable by a first scan line and a first data line, the grayscale delta is a variation between the grayscale value for the given pixel and the grayscale value for another pixel addressable by the first data line and addressable by a scan line to be addressed prior to the first scan line (304), determining an aggregated grayscale delta for the first scan line by summing the grayscale deltas of each pixel addressable by the first scan line (306), comparing a magnitude of the aggregated grayscale delta for the first scan line to a threshold value (308), modifying the image data when the magnitude of the aggregated grayscale delta equals or exceeds the threshold value such that a magnitude of a modified aggregated grayscale delta for the first scan line is below the threshold value, thereby generating modified image data (310), and displaying the image on the display using the modified image data (312).

Although referred to in this example as "grayscale," the process 300 can be used for voltage levels of any subpixel of a pixel. For example, the process 300 can be used for red, green, or blue subpixels, or for cyan, magenta or yellow subpixels. The voltage level of each of the subpixels determines the light intensity of each color. The display system may apply any image data modification proportionally to each subpixel of a pixel.

The process 300 includes receiving image data including a grayscale value for each pixel of a display (302). For example, the image data may be received at a display driver module, e.g., the column driver 110. The display driver module of a display system may receive image data for displaying an image on a flat panel display. The flat panel display may include an array of pixels electrically addressable by a plurality of scan lines and a plurality of data lines, where the scan lines are addressed sequentially in a scan direction, e.g., from top to bottom. The display driver module may be in electrical communication with the plurality of scan lines or scan driver circuits and the plurality of data lines. The grayscale value for each pixel can be a value between, for example 0 and 255 for an 8-bit grayscale display. In some examples, the grayscale value can be between 0 and 4095 for a 12-bit display, or between 0 and 65535 for a 16-bit display. In some examples, the grayscale value of a pixel is a sum of values of multiple subpixels of a pixel. The grayscale value of each pixel determines the intensity of the emitted light. For example, a grayscale value of 300 represents a greater light intensity compared to a grayscale value of 100.

The process 300 includes determining a grayscale delta for each pixel from the grayscale values where, for a given pixel addressable by a first scan line and a first data line, the grayscale delta is a variation between the grayscale value for the given pixel and the grayscale value for another pixel addressable by the first data line and addressable by a scan line to be addressed prior to the first scan line (304). For example, a given pixel addressable by a first scan line and a first data line may be the pixel 130 from FIG. 1, addressable by a data line 134 and a scan line 132. The another pixel may be the pixel 135 from FIG. 1, addressable by the data line 134 and a scan line 136, where the scan line 136 is addressed prior to the scan line 132 when displaying the image. In some examples, the given pixel and the another pixel may addressable by scan lines that are adjacent to one another, e.g., the pixel 130 and the pixel 135. In some examples, the given pixel and the another pixel may be addressable by scan lines that are separated by one or more other scan lines. For example, the given pixel may be the pixel 130, and the another pixel may be the pixel 138. Both the pixel 130 and the pixel 138 are addressable by the data line 134, but are separated by the scan line 136.

The display system determines the grayscale delta between the given pixel and the another pixel to determine the difference in intensity between two pixels in different rows within the same column of the display. The grayscale delta is determined by subtracting the grayscale value of the another pixel from the grayscale value of the given pixel. For example, the grayscale delta for pixel 130 may be determined by subtracting the grayscale value of the pixel 135 from the grayscale value of the pixel 130. The grayscale delta may be a negative value, a positive value, or zero. The display system can repeat the grayscale delta determination for each subpixel within the pixels, e.g., red, green, and blue subpixels.

In some examples, the grayscale delta can be determined by counting a part of gray level values in the digital image data. For example, only two most-significant-bits (MSBs) of the digital gray value can be used for the calculation of grayscale deltas in order to reduce required system resources and processing time.

In some examples, the determination of the grayscale delta can be varied by applying various weighting ratios in the calculation depending on the range of the respective gray levels. For example, the grayscale delta can be multiplied by two when the given pixel's original gray level is in the range of 0 to 11, while the grayscale delta can be multiplied by one when the given pixel's gray level is equal to or greater than 12.

The display system can repeat the grayscale delta determination for each pixel that is addressable by a scan line. For example, the display system can repeat the grayscale delta determination for the pixels 130, 140, and 150, each addressable by the scan line 132.

The process 300 includes determining an aggregated grayscale delta for the first scan line by summing the grayscale deltas of each pixel addressable by the first scan line (306). For example, the display system may sum the grayscale deltas of the pixels 130, 140, and 150 to determine the aggregated grayscale delta for the scan line 132. The aggregated grayscale delta may be a negative value, a positive value, or zero.

The process 300 includes comparing a magnitude of the aggregated grayscale delta for the first scan line to a threshold value, the threshold value corresponding to a data signal that results in line crosstalk (308). The magnitude of the aggregated grayscale delta is the absolute value of the aggregated grayscale delta. The display system compares the magnitude of the aggregated grayscale delta to the threshold value.

The threshold value may be a pre-programmed value that is established using empirical methods. For example, the threshold value may be established using a tuning process that is performed upon fabrication of the display. The tuning process may include adjusting the threshold value to various levels to determine the optimal threshold for reducing line crosstalk.

An example process for establish an optimal threshold value includes using a reference image. The reference image of an example 8-bit grayscale display may have a background with a gray level of 127. The reference image may include a black box with a gray level of 0, with the width of the black box extending across a portion of the width of the display active area, e.g., 33 percent of the width of the display active area. The black box may be positioned in or near the center of the display active area.

The process for establishing an optimal threshold value can include performing the process 300 for reducing display line crosstalk multiple times on the reference image. In the first iteration of performing the process 300, the display system can apply a certain threshold value and evaluating the resulting image. Specifically, the display system can evaluate the resulting image by comparing the brightness of the horizontal display line crosstalk near the top and bottom edge areas of the black box to the intended brightness. The display system can then iteratively perform the process 300, adjusting the threshold value each time, e.g., by increasing or decreasing the threshold value. The display system can establish the optimal threshold value to be the aggregated grayscale delta when the horizontal line crosstalk near the top and bottom edge areas of the black box differ from the intended brightness by a certain percentage, e.g., one percent.

The process 300 includes modifying the image data when the magnitude of the aggregated grayscale delta equals or exceeds the threshold value such that a magnitude of a modified aggregated grayscale delta for the first scan line is below the threshold value, thereby generating modified image data (310). For each scan line, if the magnitude of the aggregated grayscale delta is higher than the threshold, the display system modifies the image data by applying a softening process for the scan line. The softening process can include adjusting abrupt changes in intensity to introduce or increase gradation at the change boundaries. The modified image data includes grayscale values that result in smaller grayscale deltas between scan lines. Subject to additional criteria, the display system modifies the image data only for pixels addressable by the scan lines for which the magnitude of the aggregated grayscale deltas equals or exceeds the threshold. For example, if the magnitude of the aggregated grayscale delta for scan line 132 exceeds the threshold, the display system may modify the image data for pixels 130, 140, and/or 150. If the magnitude of the aggregated grayscale delta for scan line 136 does not exceed the threshold, the display system does not modify the image data for pixels 135, 145, or 155.

In some examples, the display system modifies the image data only for pixels that have a grayscale delta that is the same sign, i.e., positive or negative, as the aggregated grayscale delta for the corresponding scan line. For example, if the aggregated grayscale delta for scan line 132 is a positive value, and its magnitude exceeds the threshold, the display system may modify the image data for any of the pixels 130, 140, or 150 that have a positive grayscale delta.

In some examples, the display system modifies the image data only when a certain number of adjacent pixels addressable by a scan line meet the criteria for image data modification. For example, a display system may be configured such that the display system modifies the image data only when at least three adjacent pixels addressable by a scan line meet the criteria for image data modification. In this example, the aggregated grayscale delta for scan line 132 may be positive and have a magnitude that exceeds the threshold. The pixel 140 may have a positive grayscale delta, and therefore meet the criteria for image data modification. However, if either of the pixels 130 or 150 do not have a positive grayscale delta, the display system will not modify the image data for the pixel 140 because there are fewer than three adjacent pixels addressable by the scan line 132 that meet the criteria.

In some examples, the display system modifies the image data using pre-defined parameters based on the magnitude of the aggregated grayscale delta. The display system may apply various algorithms based on the magnitude of the aggregated grayscale delta and/or the amount by which the magnitude of the aggregated grayscale delta exceeds the threshold. For example, the display system may apply a certain algorithm when the magnitude of the aggregated grayscale delta exceeds the threshold by 10%, and another algorithm when the magnitude of the aggregated grayscale delta exceeds the threshold by 20%. An example algorithm is to reduce the grayscale value of the given pixel by 50%. Another example algorithm is to increase the grayscale value of the given pixel by a value that is the inverse sign of one-half of the grayscale delta of the given pixel. As a result of modifying the image data, the magnitude of the modified aggregated grayscale delta for the first scan line decreases below the threshold value.

In some examples, the display system can apply combined gray level values of subpixels (e.g. red, green, and blue) in calculating the aggregate grayscale delta of the designated pixels, and apply the same modification ratio of gray levels of each subpixel. For example, if the display system applies an algorithm of reducing the grayscale value of the given pixel by 50%, the display system can reduce each of the red, blue, and green subpixel values by 50%. The intensities of the subpixels may be adjusted in proportion such that the color of the pixel remains the same, but is displayed at a higher or lower intensity or brightness.

The process includes displaying the image on the display using the modified image data (312). The displayed image using the modified image data includes softened boundaries compared to the image using the unmodified image data. By applying the algorithms to the designated pixels, the display system reduces the abrupt changes in voltages in the display panel, which increases gradation at boundaries. Because the display system only applies the algorithms to the specific pixels that meet specified criteria, the softening only affects the abrupt boundaries that cause line crosstalk, without affecting additional pixels within the affected scan lines. This reduces artifacts in the displayed image that might occur if the algorithms were applied to all boundaries of image patterns on the screen while the display system reduces line crosstalk in the display.

FIG. 4 illustrates example grayscale value grids for an image pixel array of a flat panel display. The pixel array includes ten rows, or scan lines, represented by S=1 to S=10. The pixel array includes ten columns, or data lines, represented by D=1 to D=10. Each pixel is addressable by a scan line and a data line.

The grid 402 shows the grayscale value of each pixel in the pixel array. The grayscale value of each pixel can be represented by $G_{SD}$, where S is the addressable scan line of the pixel, and D is the addressable data line of the pixel. For example, the grayscale value of the pixel addressable by scan line 3 and data line 4 can be represented by $G_{34}$. The values $G_{SD}$ can range from 0 to 255, representing grayscale values for an 8-bit grayscale display. For example, as shown in the grid 402, $G_{34}$=230. The grid 402 includes abrupt changes in grayscale values between adjacent pixels. For example, the region of pixels between scan line 4 and scan line 7, and data line 2 and data line 8, have grayscale values of 0. The pixels surrounding the region each have a grayscale value of 230 or greater. Thus, the grid 402 shows grayscale values representing a darker region of the image that is surrounded by a brighter region of the image.

The grid 404 shows the grayscale deltas for each pixel. The grayscale delta of each pixel can be represented by $\Delta_{SD}$, where S is the addressable scan line of the pixel, and D is the addressable data line of the pixel. For example, the grayscale delta of the pixel addressable by scan line 3 and data line 4 can be represented by $\Delta_{34}$. The values $\Delta_{SD}$ can be determined by subtracting, from each pixel grayscale value, the pixel grayscale value of the preceding pixel addressable by the same data line, such that $\Delta_{SD}$ can be determined by Equation 1.

$$\Delta_{SD}=G_{SD}-G_{(S-1)D} \quad \text{Equation 1}$$

For example, the calculation of the grayscale delta for the pixel addressable by scan line 3 and data line 4, $\Delta_{34}$, is shown in Equation 2.

$$\Delta_{34}=G_{34}-G_{24}=230-240=-10 \quad \text{Equation 2}$$

Thus, as shown in the grid 404, $\Delta_{34}$=−10. The grayscale delta for each pixel may be a positive value, a negative value, or zero. The grayscale deltas for the pixels in scan line 1 cannot be calculated, since there are no preceding pixels addressable by the same data lines. Thus, the grayscale deltas for the pixels in scan line 1 are shown in the grid 404 as not applicable (N/A). In some examples, the grayscale deltas for the pixels in scan line 1 can be calculated by using the last scan line of the pixel array. For example, in the grid 404, the grayscale deltas for the pixels in scan line 1 can be calculated using scan line 10 as the preceding scan line for scan line 1.

The grid 406 shows the aggregated grayscale deltas for each scan line. The aggregated grayscale deltas for each scan line can be represented by $\Sigma_S$, where S is the scan line. For example, the aggregated grayscale delta for scan line 3 can be represented by $\Sigma_3$. The values $\Sigma_S$ can be determined by summing the grayscale deltas for each pixel in each scan line, such that $\Sigma_S$ can be determined by Equation 3.

$$\sum_S = \sum_{D=1}^{10} \Delta_{SD} \quad \text{Equation 3}$$

For example, the calculation of the aggregated grayscale delta for scan line 3, $\Sigma_3$, is shown in Equation 4.

$$\sum_3 = \sum_{D=1}^{10} \Delta_{3D} = -10 + -10 + 14 + -10 + 14 + -10 + -10 + 14 + -10 + 14 = -4 \quad \text{Equation 4}$$

Thus, as shown in the grid 406, $\Sigma_3=-4$.

To determine the image data to modify for reducing line crosstalk, the display system compares the magnitude, or absolute value, of the aggregated grayscale deltas for each scan line to a threshold value T. The threshold value may be pre-determined empirically and set at a level that optimally reduces line crosstalk. In FIG. 4, the threshold T=1500. Therefore, the display system may modify the image data for the pixels that are addressable by scan lines that have an aggregated grayscale delta magnitude greater than or equal to 1500. For example, the scan line 3 has an aggregated grayscale delta of $\Sigma_3=-4$. The magnitude of the aggregated grayscale delta for the scan line 3 is given by Equation 5.

$$|\Sigma_3|=|-4|=4 \quad \text{Equation 5}$$

Since 4<1500, the magnitude of the aggregated grayscale delta for scan line 3, $|\Sigma_3|$, is less than the threshold T. Thus, the display system will not modify the image data for the pixels addressable by the scan line 3.

The scan line 4 has an aggregated grayscale delta magnitude of $\Sigma_4=-1888$. The magnitude of the aggregated grayscale delta for the scan line 4 is therefore 1888. Since 18881500, the magnitude of the aggregated grayscale delta for scan line 4 is greater than or equal to the threshold T. Thus, subject to any additional criteria, the display system may modify the data for the pixels addressable by the scan line 4. As shown in the grid 406, the magnitude of the aggregated grayscale delta for scan lines 4 and 8 both exceed the threshold T, as indicated by bold type.

The display system might not modify the image data for every pixel addressable by scan lines 4 and 8. The display system may only modify each pixel in the scan lines 4 and 8 that meet specified criteria. For example, criteria may be that the display system modifies the image data for only the pixels that have a grayscale delta that is the same sign as the aggregated grayscale delta. For example, the magnitude of the aggregated grayscale delta for scan line 4, 1888, is greater than or equal to the threshold T. The sign of the aggregated grayscale delta, −1888, is negative. Therefore, only the pixels addressable by scan line 4 that have negative grayscale deltas may be modified. Subject to any additional criteria, the display system may modify the image data $G_{42}$, $G_{43}$, $G_{44}$, $G_{45}$, $G_{46}$, $G_{47}$, $G_{48}$, and $G_{410}$, each of which have negative grayscale deltas. The display system will not modify the image data $G_{41}$ or $G_{49}$, each of which have positive grayscale deltas.

In some examples, the criteria for modifying the image data of a pixel may include the number of adjacent pixels that will be modified. For example, criteria may be that when a selected pixel does not have at least two adjacent pixels addressable by the same scan line that will be modified, the display system will not modify the selected pixel. For example, in the grid 404, the grayscale delta $\Delta_{410}$ is −254. The grayscale delta of the adjacent pixel within the same scan line is $\Delta_{49}=24$. Since the grayscale delta $\Delta_{49}$ is a positive value, and the aggregated grayscale delta for scan line 4 is a negative value, the image data for the pixel addressable by scan line 4 and column 9 will not be modified. Thus, the pixel addressable by scan line 4 and scan line 10 does not have any adjacent pixels addressable by the same scan line that will be modified. Therefore, the display system will not modify the image data $G_{410}$.

To modify the image data for the selected pixels, the display system may apply an algorithm to the grayscale values for the selected pixels. In the example of FIG. 4, the display system applies an algorithm of increasing the grayscale values of $G_{42}$ to $G_{48}$ by a value that is the inverse sign of one-half of the grayscale delta of each pixel. For example, the grayscale delta $\Delta_{42}$ is −230. The inverse sign of one-half of the grayscale delta $\Delta_{42}$ is therefore given by Equation 6.

$$-\tfrac{1}{2}(\Delta_{42})=-\tfrac{1}{2}(-230)=115 \quad \text{Equation 6}$$

Thus, the display system applies the algorithm to modify the image data $G_{42}$ by increasing the grayscale value by 115. The modified image data for $G_{42}$ is given by Equation 7, where the modified image data for $G_{42}$ is represented by $G_{42}^*$.

$$G_{42}^*=G_{42}+(-\tfrac{1}{2}(\Delta_{42}))=0+115=115 \quad \text{Equation 7}$$

Similarly, the display system may modify the image data $G_{82}$ to $G_{88}$. For example, the modified image data for $G_{82}$ is given by Equation 8, where the modified image data for $G_{82}$ is represented by $G_{82}^*$.

$$G_{82}^*=G_{82}+(-\tfrac{1}{2}(\Delta_{82}))=254+(-\tfrac{1}{2}(254))= 254+(-127)=127 \quad \text{Equation 8}$$

FIG. 5 illustrates example grayscale value grids for an image pixel array of a flat panel display with modified grayscale data. The pixel array in FIG. 5 represents the same flat panel display as the pixel array in FIG. 4, displaying modified image data.

The grid 502 shows the modified grayscale value of each pixel. The modified grayscale value is the result of the display system applying one or more algorithms to modify the image data as described in reference to FIG. 3. Specifically, the grayscale values in the grid 502 are the result of the display system applying, to the selected pixels, an algorithm given by Equation 9.

$$G_{SD}^*=G_{SD}(-\tfrac{1}{2}(\Delta_{SD})) \quad \text{Equation 9}$$

The grayscale value of each pixel can be represented by $G_{SD}^*$, where S is the addressable scan line of the pixel, and D is the addressable data line of the pixel. For example, the grayscale value of the pixel addressable by scan line 3 and data line 4 can be represented by $G_{34}^*$. The values $G_{SD}^*$ can range from 0 to 255, representing grayscale values for an 8-bit display. For example, as shown in the grid 402, $G_{34}^*=230$. The grid 502 shows the modified grayscale values after processing by the display system to reduce line crosstalk. Thus, certain pixel grayscale values in the grid 502 are different compared to the grayscale values for the same pixels in the grid 402. Grayscale values that are different in the grid 502 compared to the grid 402 are indicated by bold type.

The grid 504 shows the modified grayscale deltas for each pixel. The modified grayscale delta of each pixel can be represented by $\Delta_{SD}^*$, where S is the addressable scan line of the pixel, and D is the addressable data line of the pixel. For example, the modified grayscale delta of the pixel addressable by scan line 3 and data line 4 can be represented by $\Delta_{34}^*$. The modified values $\Delta_{SD}$ can be determined by subtracting, from each pixel grayscale value, the pixel grayscale value of the preceding pixel addressable by the same data line, such that $\Delta_{SD}^*$ can be determined by Equation 10.

$$\Delta_{SD}^* = G_{SD}^* - G_{(S-1)D}^* \quad \text{Equation 10}$$

For example, the calculation of the modified grayscale delta for the pixel addressable by scan line 3 and data line 4, $\Delta_{34}^*$, is shown in Equation 11.

$$\Delta_{34}^* = G_{34}^* - G_{24}^* = 230 - 240 = -10 \quad \text{Equation 11}$$

Thus, as shown in the grid 504, $\Delta_{34}^* = -10$.

The grid 506 represents the modified aggregated grayscale deltas for each scan line. The modified aggregated grayscale deltas for each scan line can be represented by $\Sigma_S^*$, where S is the scan line. For example, the modified aggregated grayscale delta for scan line 3 can be represented by $\Sigma_3^*$. The values $\Sigma_S^*$ can be determined by summing the modified grayscale deltas for each pixel in each scan line, such that $\Sigma_S^*$ can be determined by Equation 12.

$$\sum_{S}^{*} = \sum_{D=1}^{10} \Delta_{SD}^* \quad \text{Equation 12}$$

For example, the calculation of the aggregated grayscale delta for scan line 3, $\Sigma_3^*$, is shown in Equation 13.

$$\sum_{3}^{*} = \sum_{D=1}^{10} \Delta_{3D}^* = -10 + -10 + 14 + -10 + 14 + -10 + -10 + 14 + -10 + 14 = -4 \quad \text{Equation 13}$$

Thus, as shown in the grid 506, $\Sigma_3^* = -4$.

The scan line 4 has a modified aggregated grayscale delta magnitude of $\Sigma_4 = -1045$. The magnitude of the modified aggregated grayscale delta for the scan line 4 is therefore 1045. Since 1045<1500, the magnitude of the modified aggregated grayscale delta for scan line 4 is less than the threshold T. This represents that the modified grayscale values in the selected data lines of the scan line 4 are closer in value to the grayscale values in the same data lines of the scan line 3, compared to the grayscale values in FIG. 3. The magnitude of the modified aggregated grayscale delta for scan line 4 is less than the threshold T even though not all of the image data for the pixels in the scan line 4 were modified. For example, the display system did not modify the image data $G_{41}$, $G_{49}$, or $G_{410}$.

In the grid 506, none of the aggregated grayscale delta magnitudes exceeds the threshold T. Thus, the display system has modified the image data for the flat screen display to increase gradation at the boundaries of the image, while reducing line crosstalk.

Figure 6:
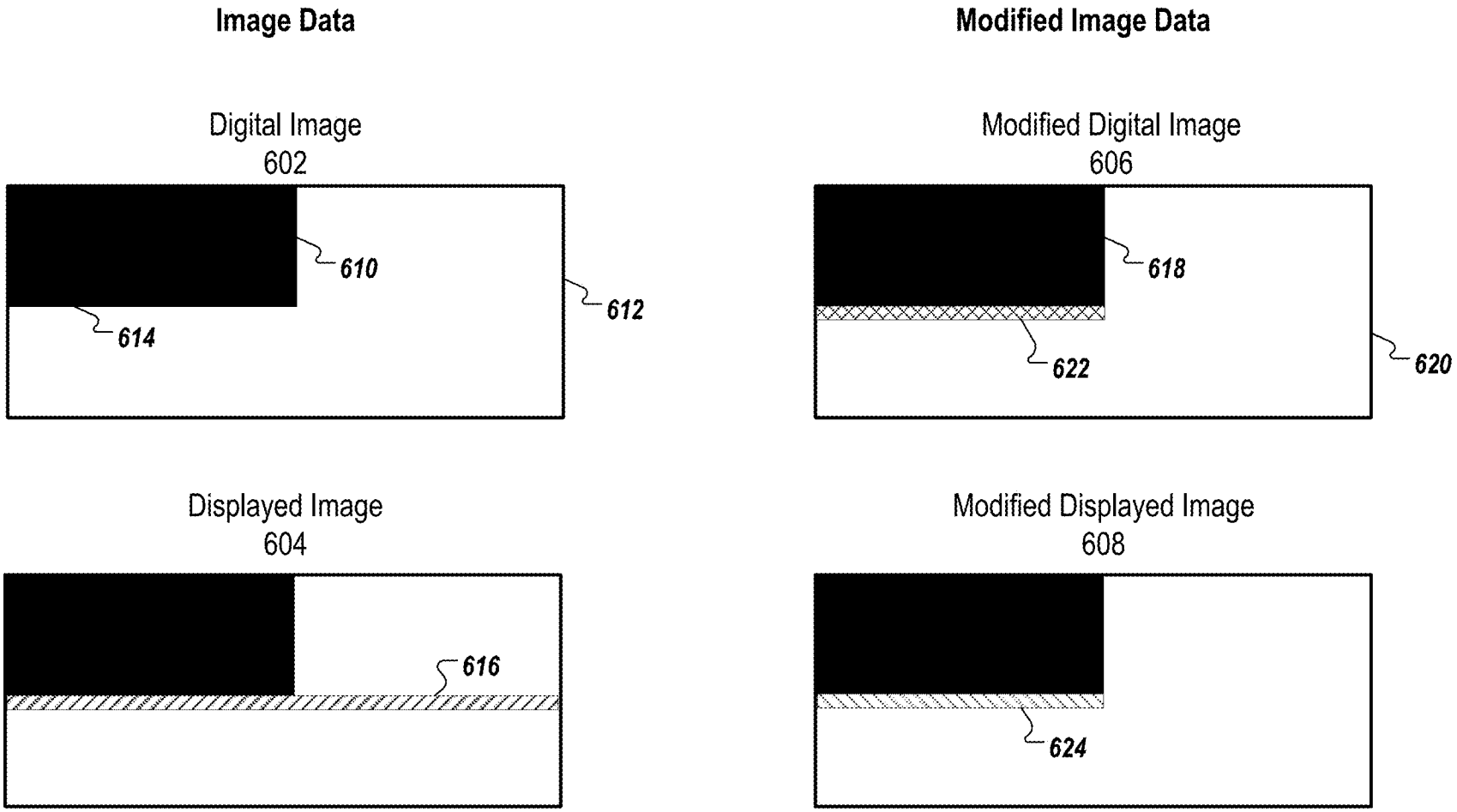
FIG. 6 illustrates example digital and displayed images using image data and using modified image data.

FIG. 6 illustrates example digital and displayed images using image data and using modified image data.

The digital image 602 includes a black region 610 and a white region 612. The grayscale values of the white region 612 each have a high gray level, e.g., 255 for an 8-bit grayscale image. The grayscale values in the black region 610 each have a low gray level, e.g., zero. The digital image 602 includes an abrupt grayscale change 614 in the left half of the image.

The displayed image 604 represents the digital image 602 displayed on a flat panel display. Due to parasitic capacitance between the data lines and other pixel circuit elements, the flat panel display may show unwanted horizontal lines along the pixel row line of the abrupt grayscale change 614. For example, the displayed image 604 includes an unwanted line, or line crosstalk 616, that extends across the entire image in the scan line direction.

The modified digital image 606 represents the digital image 602 after the display system has modified the image data to reduce line crosstalk. The modified digital image 602 includes a black region 618 and a white region 620. The modified digital image 602 also includes a gradation 622 that replaces the abrupt grayscale change 614. The gradation 622 is a region of the digital image with pixels that each have a grayscale value greater than the grayscale value of the pixels in the black region 618, but less than the grayscale value of the pixels in the white region 620. The gradation 622 is the result of modifying the image data for the pixels in the scan line at the abrupt grayscale change 614. For example, the display system may have modified the image data by applying an algorithm that decreased the grayscale value for selected pixels to create the gradation 622. The display system did not modify the image data for the data lines that did not include the abrupt grayscale change 614, i.e., the data lines in the right half of the display.

The modified displayed image 608 represents the digital image 606 displayed on a flat panel display. The modified displayed image 608 includes a softened line 624 at the location of the gradation 622 of the modified digital image 606. Since the display system only applied the algorithm to modify the image data in the data lines that included the abrupt grayscale change 614, the modified displayed image 608 does not include the line crosstalk 616. Thus, the display system has softened the abrupt grayscale change by introducing a gradation 622, while reducing line crosstalk.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory program carrier for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable processor, a computer, or multiple processors or computers. The apparatus can also be or further include special purpose logic circuitry, e.g., an FPGA (field programmable gate array) or an ASIC (application-specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub-programs, or portions of code. A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a smart phone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., LCD (liquid crystal display), OLED (organic light emitting diode) or other monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HyperText Markup Language (HTML) page, to a user device, e.g., for purposes of displaying data to and receiving user input from a user interacting with the user device, which acts as a client. Data generated at the user device, e.g., a result of the user interaction, can be received from the user device at the server.

Figure 7:
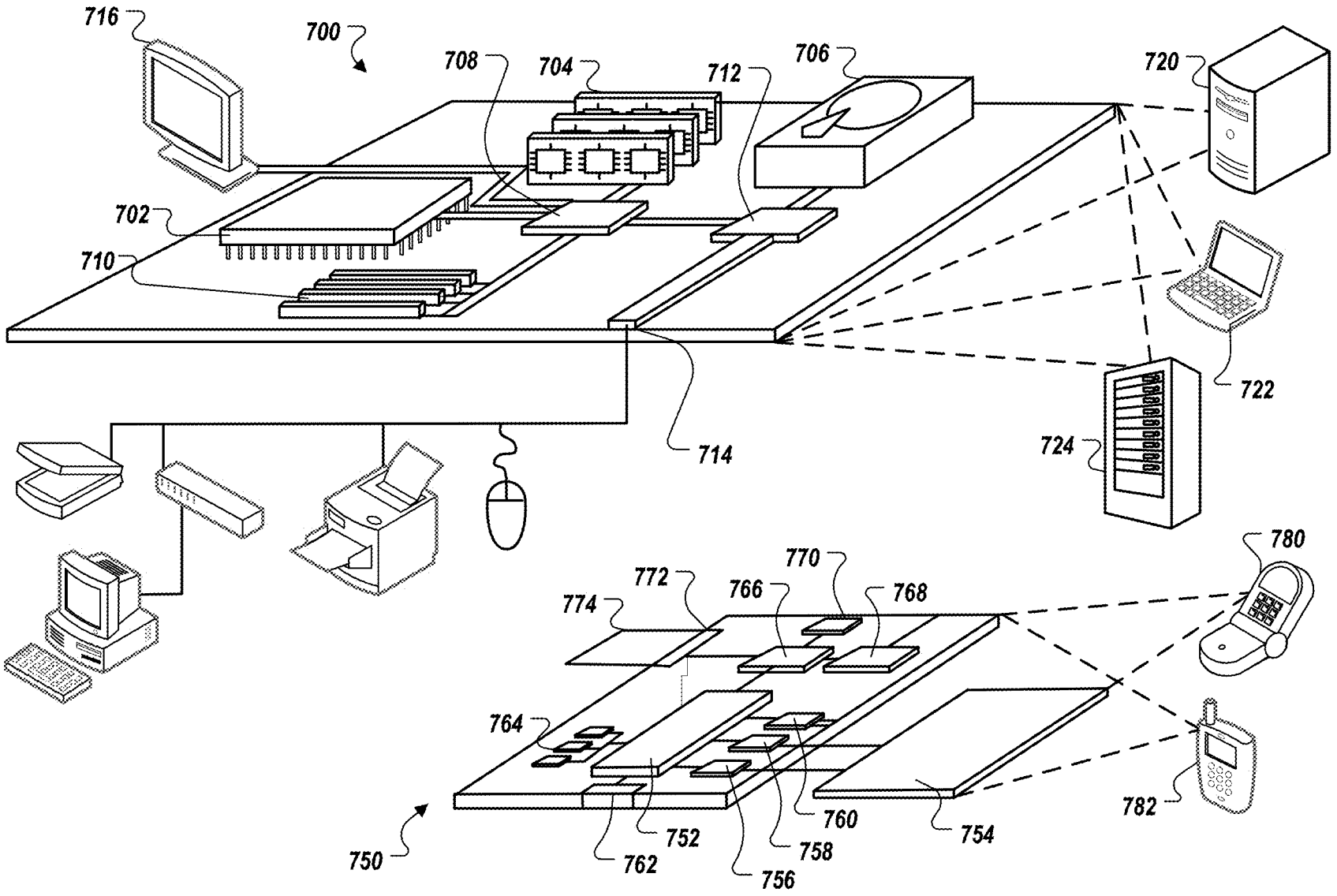
FIG. 7 is a block diagram of computing devices that may be used to implement the systems and methods described in this document, as either a client or as a server or plurality of servers.

FIG. 7 is a block diagram of computing devices 700, 750 that may be used to implement the systems and methods described in this document, as either a client or as a server or plurality of servers. Computing device 700 is intended to represent various forms of digital computers, such as laptops, desktops, workstations, personal digital assistants, servers, blade servers, mainframes, and other appropriate computers. Computing device 750 is intended to represent various forms of mobile devices, such as personal digital assistants, cellular telephones, smartphones, smartwatches, head-worn devices, and other similar computing devices. The components shown here, their connections and relationships, and their functions, are meant to be exemplary only, and are not meant to limit implementations described and/or claimed in this document.

Computing device 700 includes a processor 702, memory 704, a storage device 706, a high-speed interface 708 connecting to memory 704 and high-speed expansion ports 710, and a low speed interface 712 connecting to low speed bus 714 and storage device 706. Each of the components 702, 704, 706, 708, 710, and 712, are interconnected using various busses, and may be mounted on a common motherboard or in other manners as appropriate. The processor 702 can process instructions for execution within the computing device 700, including instructions stored in the memory 704 or on the storage device 706 to display graphical information for a GUI on an external input/output device, such as display 716 coupled to high speed interface 708. In other implementations, multiple processors and/or multiple buses may be used, as appropriate, along with multiple memories and types of memory. Also, multiple computing devices 700 may be connected, with each device providing portions of the necessary operations (e.g., as a server bank, a group of blade servers, or a multi-processor system).

The memory 704 stores information within the computing device 700. In one implementation, the memory 704 is a computer-readable medium. In one implementation, the memory 704 is a volatile memory unit or units. In another implementation, the memory 704 is a non-volatile memory unit or units.

The storage device 706 is capable of providing mass storage for the computing device 700. In one implementation, the storage device 706 is a computer-readable medium. In various different implementations, the storage device 706 may be a floppy disk device, a hard disk device, an optical disk device, or a tape device, a flash memory or other similar solid state memory device, or an array of devices, including devices in a storage area network or other configurations. In one implementation, a computer program product is tangibly embodied in an information carrier. The computer program product contains instructions that, when executed, perform one or more methods, such as those described above. The information carrier is a computer- or machine-readable medium, such as the memory 704, the storage device 706, or memory on processor 702.

The high speed controller 708 manages bandwidth-intensive operations for the computing device 700, while the low speed controller 712 manages lower bandwidth-intensive operations. Such allocation of duties is exemplary only. In one implementation, the high-speed controller 708 is coupled to memory 704, display 716 (e.g., through a graphics processor or accelerator), and to high-speed expansion ports 710, which may accept various expansion cards (not shown). In the implementation, low-speed controller 712 is coupled to storage device 706 and low-speed expansion port 714. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 700 may be implemented in a number of different forms, as shown in the figure. For example, it may be implemented as a standard server 720, or multiple times in a group of such servers. It may also be implemented as part of a rack server system 724. In addition, it may be implemented in a personal computer such as a laptop computer 722. Alternatively, components from computing device 700 may be combined with other components in a mobile device (not shown), such as device 750. Each of such devices may contain one or more of computing device 700, 750, and an entire system may be made up of multiple computing devices 700, 750 communicating with each other.

Computing device 750 includes a processor 752, memory 764, an input/output device such as a display 754, a communication interface 766, and a transceiver 768, among other components. The device 750 may also be provided with a storage device, such as a microdrive or other device, to provide additional storage. Each of the components 750, 752, 764, 754, 766, and 768, are interconnected using various buses, and several of the components may be mounted on a common motherboard or in other manners as appropriate.

The processor 752 can process instructions for execution within the computing device 750, including instructions stored in the memory 764. The processor may also include separate analog and digital processors. The processor may provide, for example, for coordination of the other components of the device 750, such as control of user interfaces, applications run by device 750, and wireless communication by device 750.

Processor 752 may communicate with a user through control interface 758 and display interface 756 coupled to a display 754. The display 754 may be, for example, a TFT LCD display or an OLED display, or other appropriate display technology. The display interface 756 may include appropriate circuitry for driving the display 754 to present graphical and other information to a user. The control interface 758 may receive commands from a user and convert them for submission to the processor 752. In addition, an external interface 762 may be provided in communication with processor 752, so as to enable near area communication of device 750 with other devices. External interface 762 may provide, for example, for wired communication (e.g., via a docking procedure) or for wireless communication (e.g., via Bluetooth or other such technologies).

The memory 764 stores information within the computing device 750. In one implementation, the memory 764 is a computer-readable medium. In one implementation, the memory 764 is a volatile memory unit or units. In another implementation, the memory 764 is a non-volatile memory unit or units. Expansion memory 774 may also be provided and connected to device 750 through expansion interface 772, which may include, for example, a SIMM card interface. Such expansion memory 774 may provide extra storage space for device 750, or may also store applications or other information for device 750. Specifically, expansion memory 774 may include instructions to carry out or supplement the processes described above, and may include secure information also. Thus, for example, expansion memory 774 may be provided as a security module for device 750, and may be programmed with instructions that permit secure use of device 750. In addition, secure applications may be provided via the SIMM cards, along with additional information, such as placing identifying information on the SIMM card in a non-hackable manner.

The memory may include for example, flash memory and/or MRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 764, expansion memory 774, or memory on processor 752.

Device 750 may communicate wirelessly through communication interface 766, which may include digital signal processing circuitry where necessary. Communication interface 766 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 768. In addition, short-range communication may occur, such as using a Bluetooth, WiFi, or other such transceiver (not shown). In addition, GPS receiver module 770 may provide additional wireless data to device 750, which may be used as appropriate by applications running on device 750.

Device 750 may also communicate audibly using audio codec 760, which may receive spoken information from a user and convert it to usable digital information. Audio codec 760 may likewise generate audible sound for a user, such as through a speaker, e.g., in a handset of device 750.

Such sound may include sound from voice telephone calls, may include recorded sound (e.g., voice messages, music files, etc.) and may also include sound generated by applications operating on device 750.

The computing device 750 may be implemented in a number of different forms, as shown in the figure. For example, it may be implemented as a cellular telephone 780. It may also be implemented as part of a smartphone 782, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A method for displaying an image on a flat panel display comprising an array of pixels electrically addressable via a plurality of scan lines and a plurality of data lines, the scan lines being addressed sequentially in a scan direction, the method comprising:

(i) receiving, at a display driver module for the flat panel display, image data for displaying the image on the flat panel display, the image data comprising a grayscale value for each pixel;

(ii) determining a grayscale delta for each pixel from the grayscale values where, for a given pixel addressable by a first scan line of the scan lines and a first data line of the data lines, the grayscale delta is a variation between the grayscale value for the given pixel and the grayscale value for another pixel addressable by the first data line and addressable by a scan line that is to be addressed prior to the first scan line when displaying the image;

(iii) determining an aggregated grayscale delta for the first scan line by summing the grayscale deltas of each pixel addressable by the first scan line;

(iv) determining that a magnitude of the aggregated grayscale delta for the first scan line equals or exceeds a threshold value, wherein the threshold value is a value of an aggregated grayscale delta that results in line crosstalk;

(v) selecting, for image modification, a subset of pixels addressable by the first scan line;

(vi) modifying the image data for the selected subset of pixels addressable by the first scan line such that a magnitude of a modified aggregated grayscale delta for the first scan line is below the threshold value, thereby generating modified image data; and (vii) displaying the image on the flat panel display using the modified image data.

2. The method of claim 1, wherein the magnitude of the aggregated grayscale delta is determined for a plurality of scan lines, and the image data is modified for respective subsets of pixels of each of the plurality of scan lines for which the magnitude of the aggregated grayscale delta equals or exceeds the threshold value.

3. The method of claim 1, wherein the another pixel is addressable by a scan line immediately next to the first scan line.

4. The method of claim 1, wherein the another pixel is addressable by a scan line separated from the first scan line by one or more other scan lines.

5. The method of claim 1, wherein the threshold value is determined empirically to be a value of an aggregated grayscale delta that results in line crosstalk for the flat panel display.

6. The method of claim 1, wherein the image data is modified by increasing or decreasing the grayscale value of the selected subset of pixels addressable by the first scan line to reduce the magnitude of the aggregated grayscale delta for the first scan line.

7. The method of claim 1, wherein selecting the subset of pixels addressable by the first scan line comprises selecting, from the pixels addressable by the first scan line, only pixels for which the grayscale delta has the same sign as the aggregated grayscale delta for the first scan line.

8. The method of claim 7, wherein selecting the subset of pixels addressable by the first scan line includes excluding, from the subset of pixels, any pixels for which both pixels immediately next to the pixel in the scan direction have an opposite sign from the aggregated grayscale delta for the first scan line.

9. The method of claim 1, wherein the grayscale value is:

a value of a subpixel of a pixel that includes multiple subpixels; or a summation of values of multiple subpixels of a pixel that includes multiple subpixels.

10. The method of claim 1, wherein the grayscale delta is a variation between a one or more most-significant-bits of the grayscale value for the given pixel and one or more most-significant-bits of the grayscale value for the another pixel.

11. The method of claim 1, wherein the grayscale delta is a variation between a weighted grayscale value for the given pixel and a weighted grayscale value for the another pixel, the method comprising:

determining a weighting ratio for each of the given pixel and the another pixel based on the respective grayscale values for the given pixel and the another pixel; and determining the weighted grayscale value for each of the given pixel and the another pixel by multiplying the grayscale values for the given pixel and the another pixel by the respective weighting ratios.

12. The method of claim 6, wherein increasing or decreasing the grayscale value of the one or more pixels comprises increasing or decreasing the grayscale value of each subpixel of the one or more pixels.

13. A flat panel display, comprising:

an array of pixels electrically addressable via a plurality of scan lines and a plurality of data lines; and a display driver module in electrical communication with the plurality of scan lines and the plurality of data lines, the display driver module being programmed to:

(i) receive image data for displaying an image on the flat panel display, the image data comprising a grayscale value for each pixel;

(ii) determine a grayscale delta for each pixel from the grayscale values where, for a given pixel addressable by a first scan line of the scan lines and a first data line of the data lines, the grayscale delta is a variation between the grayscale value for the given pixel and the grayscale value for another pixel addressable via the first data line and addressable via a scan line that is to be addressed prior to the first scan line when displaying the image;

(iii) determine an aggregated grayscale delta for the first scan line by summing the grayscale deltas of each pixel addressable by the first scan line;

(iv) determining that a magnitude of the aggregated grayscale delta for the first scan line equals or exceeds a threshold value, wherein the threshold value is a value of an aggregated grayscale delta that results in line crosstalk;

(v) select, for image modification, a subset of pixels addressable by the first scan line;

(vi) modify the image data for the selected subset of pixels addressable by the first scan line such that a magnitude of a modified aggregated grayscale delta for the first scan line is below the threshold value, thereby generating modified image data; and (vii) apply scan signals sequentially to the plurality of scan lines and data signals to the plurality of data lines to display the image on the flat panel display using the modified image data.

14. The flat panel display of claim 13, wherein the magnitude of the aggregated grayscale delta is determined for a plurality of scan lines, and the image data is modified for respective subsets of pixels of each of the plurality of scan lines for which the magnitude of the aggregated grayscale delta equals or exceeds the threshold value.

15. The flat panel display of claim 13, wherein the another pixel is addressable by a scan line immediately next to the first scan line.

16. The flat panel display of claim 13, wherein the another pixel is addressable by a scan line separated from the first scan line by one or more other scan lines.

17. The flat panel display of claim 13, wherein the threshold value is determined empirically to be a value of an aggregated grayscale delta that results in line crosstalk for the flat panel display.

18. A non-transitory computer-readable medium containing instructions which when executed on a data processing apparatus in communication with a flat panel display causes the flat panel display to display an image, the flat panel display comprising an array of pixels electrically addressable via a plurality of scan lines and a plurality of data lines, the scan lines being addressed sequentially in a scan direction, a method for displaying the image when executed comprising:

(i) receiving, at a display driver module for the flat panel display, image data for displaying the image on the flat panel display, the image data comprising a grayscale value for each pixel;

(ii) determining a grayscale delta for each pixel from the grayscale values where, for a given pixel addressable by a first scan line of the scan lines and a first data line of the data lines, the grayscale delta is a variation between the grayscale value for the given pixel and the grayscale value for another pixel addressable by the first data line and addressable by a scan line that is to be addressed prior to the first scan line when displaying the image;

(iii) determining an aggregated grayscale delta for the first scan line by summing the grayscale deltas of each pixel addressable by the first scan line;

(iv) determining that a magnitude of the aggregated grayscale delta for the first scan line equals or exceeds a threshold value, wherein the threshold value is a value of an aggregated grayscale delta that results in line crosstalk;

(v) selecting, for image modification, a subset of pixels addressable by the first scan line;

(vi) modifying the image data for the selected subset of pixels addressable by the first scan line such that a magnitude of a modified aggregated grayscale delta for the first scan line is below the threshold value, thereby generating modified image data; and (vii) displaying the image on the flat panel display using the modified image data.

19. The method of claim 1, wherein:

the aggregated grayscale delta has a positive value and selecting the subset of pixels addressable by the first scan line comprises selecting, from the pixels addressable by the first scan line, only pixels for which the grayscale delta has a positive value; or the aggregated grayscale delta has a negative value and selecting the subset of pixels addressable by the first scan line comprises selecting, from the pixels addressable by the first scan line, only pixels for which the grayscale delta has a negative value.

20. The method of claim 1, wherein modifying the image data for the selected subset of pixels addressable by the first scan line comprises increasing the grayscale value for each pixel of the selected subset by a value of negative one-half the grayscale delta for the pixel.

* * * * *